US012038252B2

(12) United States Patent
O'Loughlin

(10) Patent No.: US 12,038,252 B2
(45) Date of Patent: Jul. 16, 2024

(54) ARROW REST LIMB ATTACHMENT ASSEMBLY

(71) Applicant: Vapor Trail Inc., Ham Lake, MN (US)

(72) Inventor: Rory O'Loughlin, Orono, MN (US)

(73) Assignee: Vapor Trail Inc., Hamm Lake, MN (US)

( * ) Notice: Subject to any disclaimer, the term of this patent is extended or adjusted under 35 U.S.C. 154(b) by 84 days.

(21) Appl. No.: 17/988,132

(22) Filed: Nov. 16, 2022

(65) Prior Publication Data

US 2023/0204321 A1 Jun. 29, 2023

Related U.S. Application Data

(60) Provisional application No. 63/293,237, filed on Dec. 23, 2021.

(51) Int. Cl.
*F41B 5/14* (2006.01)
*F41B 5/22* (2006.01)

(52) U.S. Cl.
CPC ..... *F41B 5/143* (2013.01); *F41B 5/14* (2013.01); *F41B 5/1403* (2013.01)

(58) Field of Classification Search
CPC ..... F41B 5/143; F41B 5/14; F41B 5/1403; F41B 5/1434; F41B 5/1438
USPC ..... 124/80, 31, 35.1
See application file for complete search history.

(56) References Cited

U.S. PATENT DOCUMENTS

| | | | | |
|---|---|---|---|---|
| 4,287,868 | A * | 9/1981 | Schiff | F41B 5/143 124/44.5 |
| 5,341,792 | A * | 8/1994 | Pucillo | F41B 5/10 124/23.1 |
| 5,383,441 | A * | 1/1995 | Lightcap, Jr. | F41B 5/143 124/44.5 |
| 5,421,314 | A * | 6/1995 | Kidney | F41B 5/143 124/44.5 |
| 6,202,635 | B1 * | 3/2001 | Evans | F41B 5/143 124/44.5 |
| 6,782,881 | B2 | 8/2004 | Mizek et al. | |
| 8,544,457 | B1 * | 10/2013 | Munsell | F41B 5/143 124/44.5 |
| 10,852,097 | B2 | 12/2020 | Wilson et al. | |
| 2008/0173290 | A1 * | 7/2008 | Harwath | F41B 5/143 124/44.5 |
| 2011/0067682 | A1 * | 3/2011 | Blosser | F41G 1/467 124/87 |

(Continued)

*Primary Examiner* — John E Simms, Jr.
(74) *Attorney, Agent, or Firm* — Warner Norcross + Judd LLP

(57) ABSTRACT

An arrow rest activation cord mounting assembly is provided including an elongated base mountable to a limb of an archery bow, a rail joined with the base, a mounting block moveable between a first end and a second end of the rail along the longitudinal axis to a plurality of discrete locations, and an anchor configured to receive an activation cord. The mounting block can be selectively positioned along the rail to set the anchor and activation cord at one or more different locations relative to the limb and thereby tune the activation of an arrow rest mounted to the archery bow with the activation cord. The rail can include multiple indicia elements of a scale to repeatedly set the block and anchor in discrete locations along the limb. The first end can extend in a cantilevered manner beyond a tip of the limb. A related method of use is provided.

20 Claims, 7 Drawing Sheets

(56) References Cited

U.S. PATENT DOCUMENTS

| | | | | |
|---|---|---|---|---|
| 2020/0116452 | A1* | 4/2020 | Wilson | F41B 5/143 |
| 2021/0254923 | A1 | 8/2021 | Summer et al. | |

* cited by examiner

ARROW REST LIMB ATTACHMENT ASSEMBLY

BACKGROUND OF THE INVENTION

The present invention relates to archery arrow rests, and more particularly to a limb attachment assembly for use with archery arrow rests.

Most archery bows are equipped with an arrow rest that supports an arrow before it is shot from the bow. One common arrow rest is referred to as a "drop away" arrow rest. This rest precisely and accurately positions the arrow when the bow (and thus, the bowstring) is at full draw. This rest also drops rapidly away from the arrow after a predetermined amount of travel of the arrow over the rest upon release of the bowstring during the shot cycle. Accordingly, the rest does not contact the arrow for its full length, and also does not contact the arrow's fletching to divert the arrow from an intended trajectory as the arrow is shot from the bow.

A notable feature of the modern drop away arrow rest is the precise engagement of the rest with the arrow as the arrow moves along a travel path while the arrow is still nocked to the bowstring, for example, while the arrow is initially propelled by the bowstring during a shot cycle. This affects the eventual trajectory of the arrow after it disengages the bowstring, and thus the accuracy and precision of the point of impact of the arrow relative to an intended target.

Engagement of the rest with the arrow is controlled by an actuator, typically in the form of a cord that is attached to an arrow rest arm which supports the arrow. Rotation of the arm downward disengages it from the arrow shaft. The cord can be attached to a power cable or a limb of the archery bow, however, its attachment should be precise and calibrated to move the arm and thus disengage it from the arrow at a suitable time and location along the arrow's pathway as it is still nocked to the bowstring and moving.

When attached to the limb, the cord is tied to a part of the limb near a cam axle. Where the limb activation cord is tied along the limb directly affects the support time of the arm for the arrow during a shot cycle. The cord attachment location on the limb is frequently adjusted and calibrated to tune the rest. In some cases, an archer can use a device referred to as a limb pad to secure the cord to the limb. One such limb pad is the popular Vapor Trail limb pad available from Vapor Trail Archery of Ham Lake, Minnesota. This limb pad includes an adhesive covered lower surface to secure it to a limb surface, and an upper surface including an array of pointed projections.

While this type of limb pad works well to hold the cord in a fixed relation along the limb and provide a desired actuation of the arrow rest upon movement of the limb, and the attendant support time for the arrow, it can sometimes suffer some shortcomings. For example, the limb pad projects upwardly from the limb and can be moved or dislodged. The adhesive can heat up and allow the pad to move in some cases. The limb pad also does not provide much guidance to an archer when precise movement of the cord relative to the pad is desired, so many times, an archer has difficulty in repeating an exact placement of the cord relative to the pad if the cord is removed or replaced. Thus, some current limb pads fall short of providing consistent and reproducible adjustments.

Accordingly, there remains room for improvement in limb attachment systems for use with limb activation cords of arrow rests to fine tune adjustment and placement of the cord along an archery bow limb.

SUMMARY OF THE INVENTION

An arrow rest activation cord mounting assembly is provided including an elongated base mountable to a limb of an archery bow, a rail joined with the base, a mounting block moveable between a first end and a second end of the rail along the longitudinal axis to a plurality of discrete locations, and an anchor configured to receive an activation cord. The mounting block can be selectively positioned along the rail to set the anchor and activation cord relative to the limb and thereby tune the activation of an arrow rest mounted to the archery bow with the activation cord.

In one embodiment, the rail can include a scale relative to which the mounting block and anchor can be moved. The scale can include multiple indicia elements that facilitate repeatable and consistent setting of the block in predetermined locations along the rail to tune the location of the activation cord along the limb, and thus the activation of an arrow rest arm to which the cord is connected.

In another embodiment, the mounting block can be slidably joined with the rail and moveable there along between the first end and the second end in a linear manner along the longitudinal axis to one or more discrete locations. The mounting block can include one or more edges that align with an indicia element of the scale to provide visual feedback to a user with regard to the location of the mounting block along the rail. The user can use this registration to incrementally adjust and/or fine tune the positon of the mounting block and activation cord relative to the limb.

In still another embodiment, the rail can include a first recess on a first side of the longitudinal axis and a second recess on an opposing second side of the longitudinal axis. The mounting block can include a first arm and an opposing second arm. The first arm can be slidably mounted in the first recess. The second arm can be slidably mounted in the second recess so that the block remains registered with the rail while the activation cord operates.

In yet another embodiment, the assembly can include a fastener threadably engaged with the mounting block including a fastener tip. The fastener tip can engages the rail to secure the mounting block in a preselected position along the rail.

In even another embodiment, the rail and the base can extend in a cantilevered manner beyond a tip of the limb. In this construction, the first end of the rail, and some of the indicia elements of the scale also can extend beyond the tip. The mounting block can be moved outward, along the rail, beyond the tip of the limb. As a result, the anchor and activation cord can be connected to the limb beyond its limb tip.

In a further embodiment, the rail and/or base can define a limb fastener hole so that the rail can be secured to the limb with the fastener. The rail and/or base can define at least one hole sized to receive a head of the limb fastener so that the head of the limb fastener is disposed below a display surface upon which the indicia elements are located. In turn, with the head recessed in the rail, the mounting block can still slide over the head along the rail unimpaired by the same.

In still a further embodiment, a related method of use is provided. The method can include mounting a rail to a limb of an archery bow, the rail including a longitudinal axis extending between a first and a second end; moving a mounting block between the first end and the second end along the longitudinal axis to a position along the rail aligned with an indicia element of a scale; and joining an arrow rest activation cord with an anchor joined with the mounting block.

In yet a further embodiment, the method can include selectively aligning the mounting block with at least one indicia element of the scale along the rail to set the anchor and activation cord in a preselected position. With alignment, activation of an arrow rest mounted to the archery bow with the activation cord can be tuned.

In even a further embodiment, the method can include mounting the rail to the limb so that the first end projects a first distance beyond a tip of the limb in a cantilevered manner. With the rail so mounted, the mounting block, anchor and activation cord can be moved along the rail to a position beyond the tip of the limb as well in some cases based on the user's preferences.

The limb attachment assembly for an arrow rest activation cord of the current embodiments provides a simple and efficient mechanism to mount, alter and precisely tune the location of the cord along the limb, and thereby time the movement of a support arm of an arrow rest activated by the cord. The limb activation cord directly affects the support time of the arrow rest support arm for an arrow during a shot cycle of the archery bow. With the assembly, a user can precisely and consistently attach the limb activation cord toward the tip of a limb, to provide a longer support time for the arrow according to the user's preferences and the associated archery bow's operation. Where the rail and anchor are mounted so they extend beyond the limb tip, extra adjustment of the timing can be provided. With the assembly, the user also can precisely and consistently attach the limb activation cord closer to the riser on the limb, to provide less support time for the arrow according to the user's preferences and the associated archery bow's operation. Generally, the limb attachment assembly can enable a user to micro adjust their support time and be able to achieve the exceptional support time for an arrow during the shot cycle, approaching 50%, 60%, 70% or more of the cycle.

These and other objects, advantages and features of the invention will be more readily understood and appreciated by reference to the detailed description of the invention and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
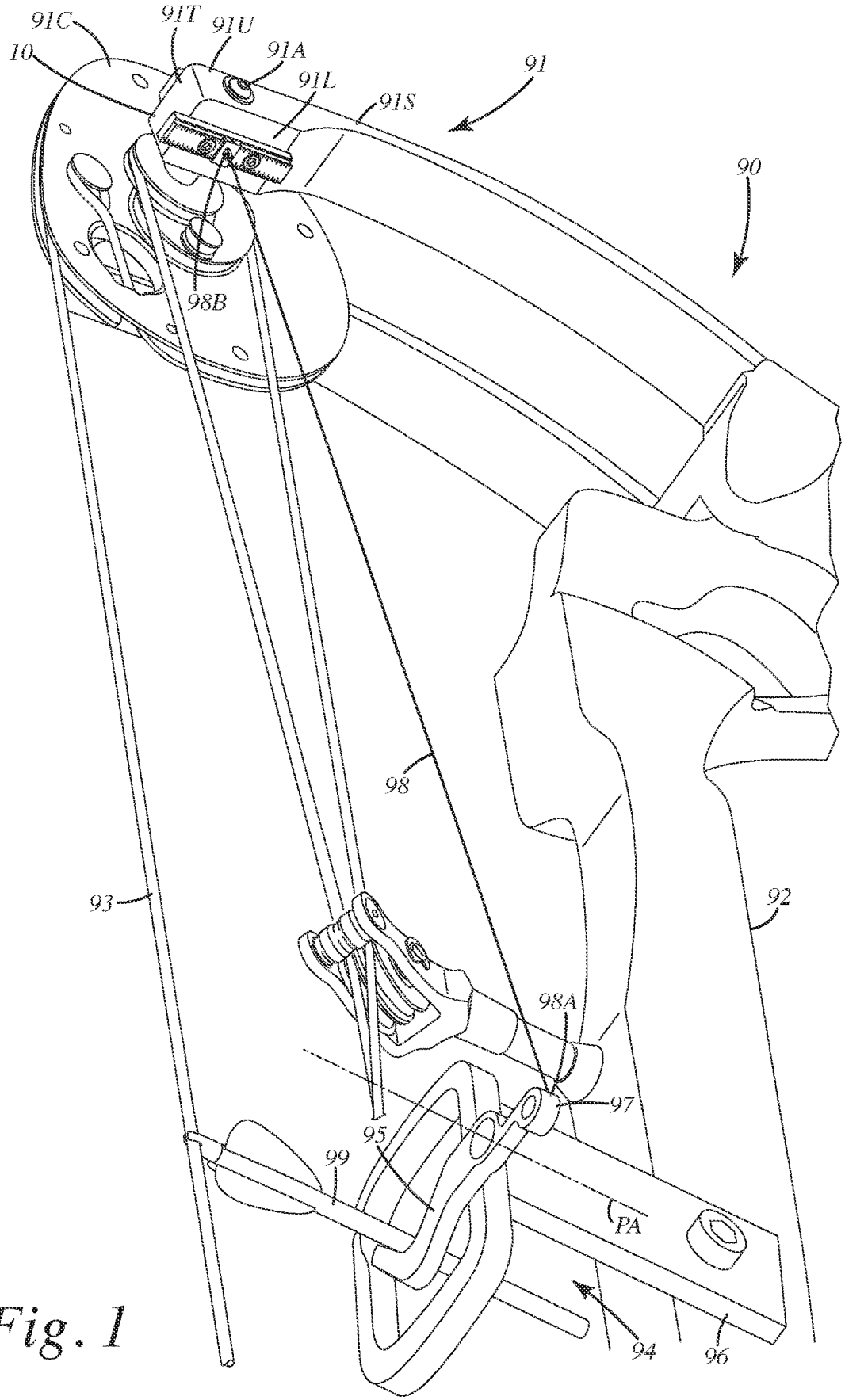
FIG. 1 is a perspective view of an arrow rest activation cord limb attachment assembly of a current embodiment installed on an archery bow.

An arrow rest activation cord limb attachment assembly or system constructed in accordance with a current embodiment is illustrated in FIGS. 1-4 and generally designated 10. The limb attachment assembly or system 10 can be joined with a limb 91 of a bow 90 including a riser to which an arrow rest 94 is mounted as shown in FIG. 1. The limb attachment system 10 can include an elongated base 20 joined with a rail 30. A mounting block 40 can be selectively slidable or moveable relative to the rail 30. An anchor 50 can be joined with the mounting block 40, and an arrow rest activation cord 98 can be tied or otherwise attached to the anchor. The mounting block 40 and the anchor 50 joined with it can be moved along the rail in a forward direction F or in a rearward direction R, and thus along the limb 91, to selectively tune the activation of the arrow rest 84, and in particular, time the movement and/or disengagement of the arrow rest arm 95 relative to an arrow 99 supported by the arm 95.

As mentioned above, the anchored location of the limb activation cord 98 relative to the limb 91 can be achieved by moving the mounting block 40 and anchor 50 along the rail with the assembly 10, affects the support time of the support arm for 95 on the arrow 99 during a shot cycle. With the assembly 10, a user can precisely and consistently attach the limb activation cord 98, via the mounting block's placement along the rail, toward the tip 91T of the limb 91 (which as shown is an upper limb, but could alternatively be a lower limb), to provide more support time for the arrow 99 on the support arm 95 during the shot cycle as the arrow is initially propelled by the bowstring 93, according to the user's preferences and/or the bow's or rest's operation and timing characteristics. With the assembly 10, the user also can precisely and consistently attach the limb activation cord 98, via the mounting block's placement along the rail, away from the tip 91T of the limb 91 in direction F, closer to the riser 92, to provide less support time for the arrow 99 on the support arm 95 during the shot cycle as the arrow is initially propelled by the bowstring 93 according to the user's preferences and/or the bow's or rest's operation and timing characteristics.

For purposes of disclosure, the arrow rest activation cord limb attachment system 10 is described in connection with an archery bow 90, however the system is well suited for use with any other type of projectile shooting device, such as a compound bow a crossbow, or other weapon system. Although described and shown in connection with a drop away arrow rest 94, the arrow rest mounting system can be used with any type of arrow rest. Further, the limb attachment system can be used to attach any other moving component to the archery bow for purposes of activating the arrow rest via the activation cord.

As mentioned above, the system 10 can actuate the arrow rest 94 mounted to the bow via a mount 96. The rest 94 can be joined with a mount 96 mounted directly to the riser 92. The rest can include a lever 97 joined with the arrow support arm 95 that engages and supports an arrow 99 when nocked on the bowstring 93 at rest, during drawing and during a shot cycle. The lever 97 and arm 95 can be connected, and can rotate about a pivot axis PA that is parallel to the bowstring plane in which the bowstring 93 moves. The activation cord 98, and in particular its end 98A, can be joined with the lever 97. For example, its first end 98A can be tied, clamped, glued, fastened or otherwise secured to that lever to promote, allow, facilitate or cause rotation of the lever and arm about the axis PA, directly or indirectly by countering an optional spring associated with the arm. The cord 98 can be a braided cord, rope, string, bar, or other elongated element that generally connects the lever and arm to another moving component of the bow 90, for example the limb 91. The activation cord 98 can extend optionally under tension away from the lever toward the limb 91 and its second end 98B can be secured, attached or otherwise joined with the limb 91 via the limb attachment system or assembly 10.

Figure 2:
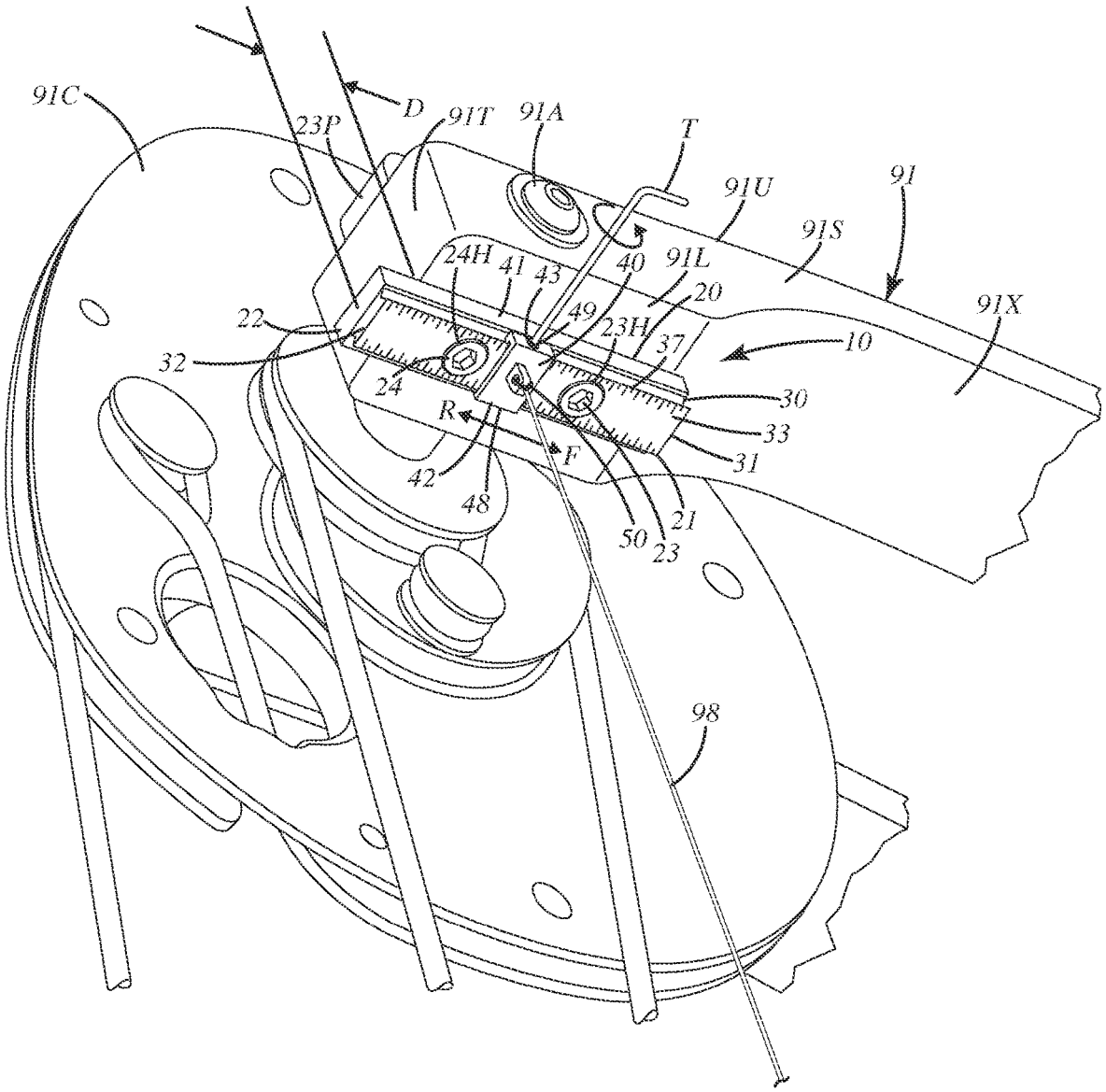
FIG. 2 is a close up perspective view of the limb attachment assembly.

The limb attachment assembly 10 shown in FIG. 2 can be secured to the limb 91. In particular, the limb attachment assembly can be secured to the limb 91 of the archery bow 90 adjacent a tip 91T of the limb 91 of the archery bow 90. The limb attachment assembly 10 can be secured adjacent an axle or axle screw 91A that connects a cam 91C rotatably to the limb 91. As used herein, a cam can include eccentric cam, a non-eccentric cam, a pulley, or other rotating element that guides the bowstring, cables or other elongated elements of the bow. The limb tip 91T as shown can form the rearward most extremity of the limb 91. Although not shown, the tip 91T can include a cover, plate or other element joined with or extending from it and/or adjacent the axle or axle screw 91A. The limb 91 as shown can be in the form of a split limb, but of course can be in the form of a solid limb or other limb construction. The limb 91 can include a split limb portion 91X that receives a portion of the axle or axle screw 91A. This limb portion 91X can include a lower surface 91L opposite an upper surface 91U. The limb attachment system 10 can be secured to the lower surface 91L of the limb 91 as shown. Of course, in other embodiments and constructions, the limb attachment system 10 can be attached to the side surface 91S or the upper surface 91U of the limb 91, adjacent the tip 91T.

Figure 4:
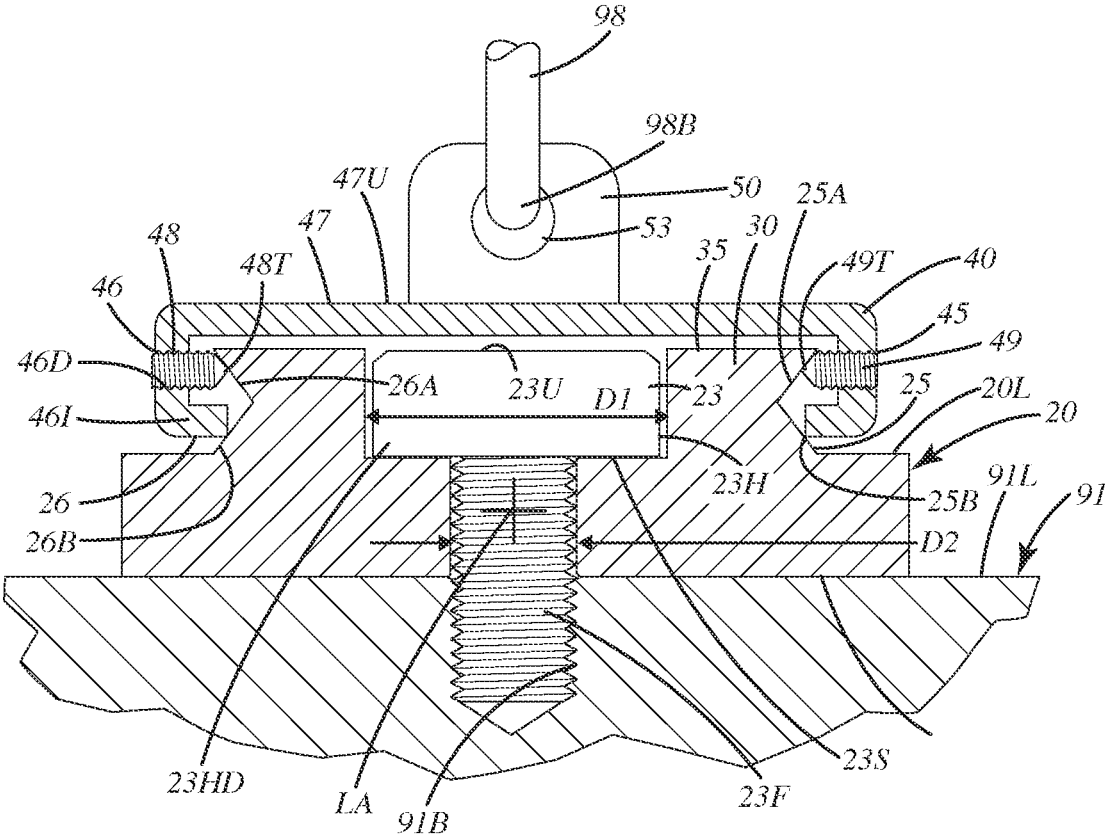
FIG. 4 is a section view of the limb attachment assembly.

With further reference to FIG. 2, the assembly 10 can be secured to the limb 91 via one or more limb fasteners 23 and 24 that engage the base 20 and/or the rail 30 to secure the limb attachment assembly 10 to the limb 91. These fasteners 23, 24 optionally can be in the form of threaded screws that thread into an anchor plate 23P which can be used to add extra support to the axle or axle screw 91A and/or the tip 91T of the limb 91. The fasteners can be countersunk in holes 23H, 24H defined by the base 20 and/or the rail 30. As shown in FIG. 4, the exemplary fastener 23 can include a head 23HD and a shaft 23F. The base and the rail 30 can define fastener holes 23H, 24H. The fastener 23 can be disposed of the fastener hole 23H.

Optionally, as shown, the fastener hole 23H can include a shoulder 23S that engages a lower surface or underside of the head 23HD. The fastener hole 23H above the shoulder 23S can include a first diameter D1 that is greater than a second diameter D2 of the hole 23H below the shoulder 23S. The head 23H optionally can fit within the diameter D1 but not within the diameter D2. The shaft 23F can extend in the smaller diameter portion of the hole 23H and further into a bore 91B of the limb 91. The shaft can thread into and/or secure to the plate 23P and the upper surface 91U of the limb 91 to secure the plate and limb attachment assembly 10 to the end of the limb 91 adjacent the tip 91T.

As further shown in FIG. 4, the hole 23H can be sized to receive the head 23HD of the limb fasteners 23 so that the head 23HD is disposed adjacent a display surface 35 of the rail 30. The display surface 35 optionally can include indicia elements 37 as described below. The upper surface 23U of the head 23HD can be disposed flush with and/or below the display surface 35, which can also be an upper surface of the rail 30. This positioning of the head below this display surface 35 can allow the mounting block 40 to easily slide, move or be conveyed along the rail, without the limb fasteners 23 and 24 interfering with such movement. Optionally, in other constructions, the limb fasteners can have different orientations and constructions, or as described below can be absent from the connection between the limb attachment assembly 10 and the limb 91. Further optionally, although shown as to limb fastener 23 and 24, a single fastener or additional limb fasters can be included to secure the limb attachment assembly 10 to the limb. In other cases, the limb attachment assembly 10, in particular, the base 20 can be glued, fastened, secured, molded and/or integrally formed with the limb 91, for example, the lower surface 91L, the side surface 91S and/or the upper surface 91T of the limb 91. In yet other embodiments, the limb attachment assembly 10 can be integrally formed with and axle plate 23P which can be disposed on the lower surface 91L of the limb, or any of the other surfaces described above.

Turning now to the construction of the limb attachment system, the base 20, rail 30 and mounting blot 40 and anchor 50 will now be described in further detail with reference to FIGS. 2-4. The base 20 can include a lower surface 20L and an upper surface 20U. The base 20 can extend from a first end 21 to a second end 22. As mentioned above, the base can define all or a portion of the respective limb fastener holes 23H and 24H where included. The upper surface 20U can be seated against and/or directly engage the lower surface 91L of the limb 91 in the embodiment shown. Of course that surface 20U can engage other surfaces of the limb depending on the placement of the assembly 10 relative to the limb. Further, although not shown, the upper surface 20U of the base can be in some cases contoured to follow the lower surface 91L of the limb. Further optionally, although not shown, the base 20 can include a rubber sub-base or pad that can conform to the contours of the lower surface 91L of the limb 91. This pad can be constructed from rubber, silicone, polymers or other materials and can be rigid or flexible, and can conform to the lower surface 91L of the limb 91.

The rail 30 can be joined with the elongated base 20, for example, the rail can be integrally formed with, fastened to, connected to or otherwise adjacent the base 20. The rail 30 can likewise include a first end 31 and a second end 32 distal from the first end. These can correspond to the ends of the base. The rail 30 can extend along the base 20 and can include a longitudinal axis LA. The base also can include and extend along this longitudinal axis LA. The longitudinal axis LA can be transverse to an axis of rotation of the cam 91C of the bow 90 as shown in FIG. 2. The longitudinal axis can be perpendicular to the axis of rotation of the cam and to the axle and/or axle screw 91A. The longitudinal axis LA can be generally parallel to the length of the limb 91 to which the system 10 is attached.

The rail 30 can be joined with and/or include indicia elements 37 which can be in the form of a scale. These indicia elements 37 can be in the form of multiple lines or line segments as shown in FIG. 3, and can extend transversely to the longitudinal axis LA. These lines or segments can be equally spaced along the length of the rail 30 and can correspond to predetermined measurement increments, for example, millimeters or portions of an inch, depending on the desired scale. The indicia elements 37 of the scale can be used provide visual feedback to a user moving the mounting block 40 along the rail as described below. With the indicia elements, a user can align a portion of the mounting block 40 with a preselected one or more of the indicia elements 37 so as to precisely, repeatedly and/or consistently place the mounting block 40 along the rail and thereby correspondingly place the anchor 50 and the attached cord 98 along the limb 91.

As an example, the mounting block 40 can include a first edge 41 and a second edge 42. The user can align the first edge 41 and a particular indicia element 37A to precisely position the mounting block 40 relative to the rail and thus the limb. Later, in an attempt to adjust the timing of the arrow support by the arm, the user can move the attachment point of the activation cord 98 relative to the limb 91, and move the mounting block 40 such that the first edge 41 lines with a second indicia element 37B, which is different from and distal from the first indicia element 37A. The user can mentally note or record the improvement or decline in the timing of the arrow rest support arm 95 engaging the arrow 99 based on these different positions, and can select the better of the positions or a completely different position by moving the mounting block 40 and the edge 41 relative to the indicia elements and of the scale. Further optionally, although not shown, the indicia elements 37 of the scale can include alphanumeric characters for further reference by a user.

Figure 3:
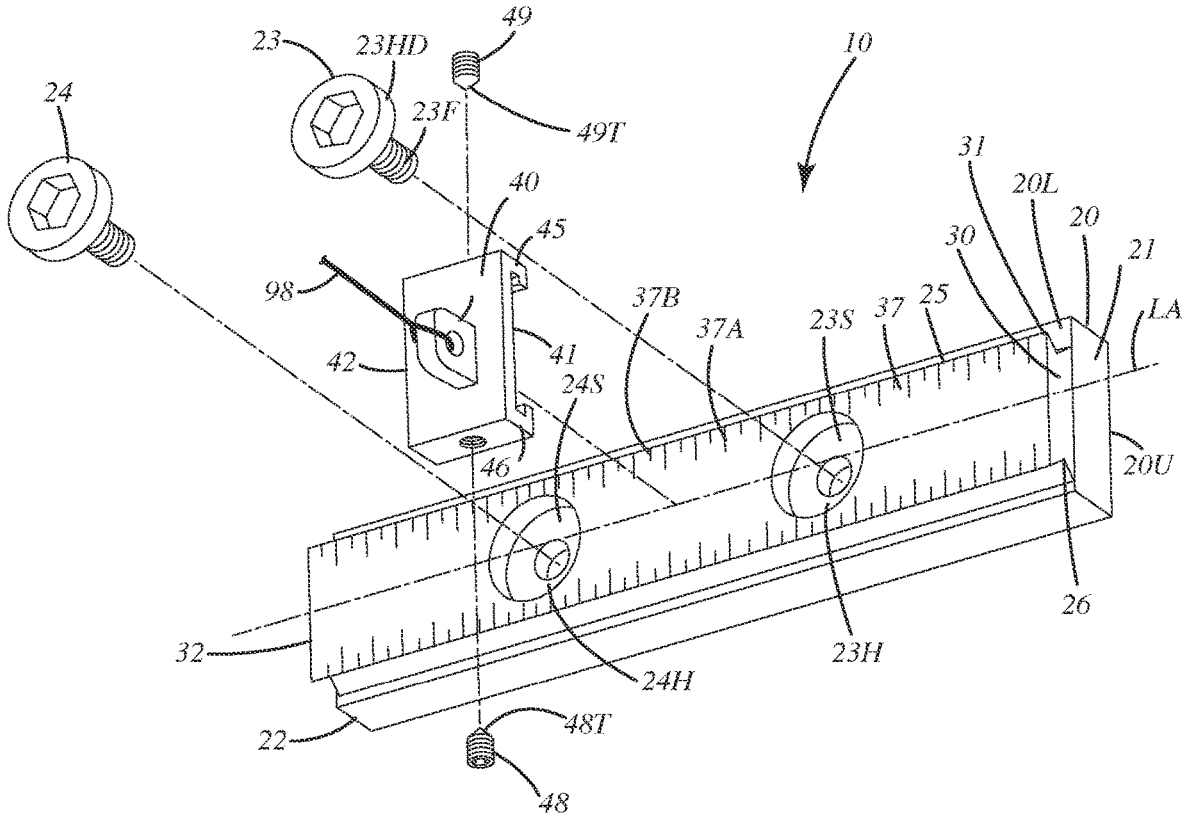
FIG. 3 is an exploded view of the limb attachment assembly.

As shown in FIGS. 3 and 4, the rail 30 can include a first recess 25 and a second recess 26. These recesses can extend along and can be parallel to the longitudinal axis LA. The recesses can be disposed on opposite sides of the longitudinal axis. The recesses 25 and 26 can be in the form of slots having one or more surfaces curved or angled to one another. For example, as shown in FIG. 4, the recess 25 can be in the form of a slot having a first surface 25A angled relative to a second surface 25B. Surfaces 25A and 25B can be at an angle acute angle, a right angle or an obtuse angle relative to one another. In other cases, the recesses 25 can be formed via an undercut located under the display surface 35. In some cases, the recesses can be constructed relative to the rail to form a Picatinny rail according to Military Specification MIL-STD-1913. In other cases, the recesses can be formed relative to the rail to form a Weaver rail mount.

As shown in FIG. 4, the recesses 25 and 26 can be configured so that the rail can interface with the mounting block 40. In particular, the mounting block 40 can include a first arm 45 and a second arm 46. The first arm and second arm can be attached to a central portion 47 of the mounting block which can extend laterally and transversely across the longitudinal axis LA. Optionally, the central portion 47 can be the portion of the mounting block to which the anchor 50 is joined. The anchor 50 can extend upwardly from the upper surface 47U of the central portion 47 of the mounting block 40.

The first and second arms can be similar so only the second arm 46 is described here with reference to FIG. 4. In particular, the second arm 46 can include a downwardly extending flange 46D which extends downwardly from the central portion 47 of the mounting block. This downwardly extending flange 46D can transition to an inwardly extending portion 461 of the arm 46. This inwardly extending portion 461 can partially or fully fit within the recess 26 and can be sized to engage the surface 26A to prevent the arm 46 from becoming disengaged from the rail 20. In some cases, the inward extending portion 461 can extend directly toward the longitudinal axis LA of the plane within which it lays. The inwardly extending portion 461 can be configured so that it can engage one or both of the angled surfaces 26A and 26B depending on the application. This outward extending portion 461 however can be left with some tolerance between it and the rail in the surfaces 26A, 26B or any other contours of the recess. This can allow relative movement of the inner portion and thus the mounting block 40 relative to the rail and base as described further below.

Optionally, the first and second arms 45 and 46 can be configured to include respective locking fasteners 48 and 49. The fasteners can be in the form of small set screws that are threaded in corresponding holes defined by the downward extending flanges, for example 46D of the arm 46. These locking fasteners can include tips 48T and 49T. Each of the fasteners can be advanced by threading into respective holes so that the fastener tips thereof engage the recesses and more generally the rail to secure the mounting block 40 in a preselected position along the rail 30. The tips 48T and 49T optionally can engage one or more of the angled surfaces or other contours of the recesses and/or an undercut associated with the rail to secure the mounting block 40 to the rail and/or otherwise set the mounting block 40 in a fixed position along the longitudinal axis of the rail and/or the base. Again, with this secure connection, the anchor 50 and the associated activation cord 98 can be locked or fixed in a position along the rail and thus along the limb 91. When the locking fasteners are tightened, they optionally can clamp against the rail and impair or prevent sliding movement of the mounting block relative to the rail. When the locking fasteners are loosened, they can disengage the rail allowing the mounting block to be moved along the rail to provide adjustment tuning of the attachment point of the activation cord relative to the limb via the assembly 10.

As shown in FIGS. 3 and 4, the mounting block can be of a channel shape and can extend over and can conceal a portion of the indicia elements 37 of the scale where the mounting block is disposed along the rail. Of course, the remaining portion of the indicia elements located along the rail beyond the first 41 and second 42 edges of the mounting block 40 can be exposed and viewable by a user to provide feedback regarding the location of those edges of the mounting block relative to the scale. The remaining portion of the indicia elements beyond the edges of the mounting block also can be located between that respective edge and the first end 31 or the second end 32 of the rail 30.

With further reference to FIGS. 1-4, the mounting block 40 can include an anchor 50 that is joined with the mounting block. Optionally, the anchor can be in the form of a flange that extends upright from the upper surface 47U of the central portion 47 of the mounting block 40. The flange can define a flange aperture 53 through which the second end 98B of the activation cord 98 can fit. The second end 98B can be tied in a knot so that the knot is larger than the aperture 53 and cannot be removed therefrom. In other cases, the end 98B can be tied to the remaining portion of the activation cord 98. Although shown as a flange with a aperture, the anchor 50 can take on other forms. For example, it can be in the form of a slot that simply receives a tied portion or not of the second end 98B. In other constructions, the anchor can include a clamp, set screw, cam, or other element that is able to grip and secure or otherwise hold the end of the cord 98 and secure it well to the mounting block 40.

The limb attachment assembly 10 can be constructed and oriented along the limb to provide a greater range of adjustment than the surfaces of the limb 91 ordinarily allow. For example, in some embodiments, the base 20 and the assembly 10 in general are mountable to the limb 91 so that the base and limb project a first distance D beyond the tip 91T of the limb 91. As a more particular example, the base and rail, and each of their respective second ends 22, 32 can extend beyond the outermost extremity of the tip 91T the distance D. This distance D optionally can be at least 1 mm, at least 2 mm, at least 3 mm, at least 4 mm, at least 5 mm, at least 10 mm or more depending on the range of adjustment that is desired by the user using the limb attachment assembly 10. When the ends of the base and rail extend beyond the tip 91T of the limb, they can extend in a cantilevered manner, with the ends 22, 32 free from attachment or engagement with the limb within the first distance D. Within this distance D, the surface 20U does not contact or engage the lower surface of the limb at the end 22; however, that surface can contact or engage or be adjacent the lower surface of the limb at the other end 21, for another distance greater than the distance D.

Optionally, with this extra cantilevered portion of the assembly, the mounting block 40 and associated anchor 50 can be placed and secured somewhere in the region of the first distance D that extends beyond the limb tip 91T. Thus, the activation cord 98 can likewise be attached to the limb, and can extend beyond the tip of the limb at that attachment. This can provide extra adjustment for the actuation cord beyond the normal surfaces of the limb.

The components of the limb attachment assembly 10 all can be constructed from a similar material, such as a metal, composites, polymers or combinations of the foregoing. Each of these components can be molded, cast, machined, 3D printed or otherwise manufactured according to various techniques. Further, although described as joined with one another, the rail and base can be integrally formed and/or included with one another as a single piece. The latter constructions also are encompassed when these components are described as joined with one another.

A method of mounting the arrest activation cord to an archery bow according to the current embodiment will now be described with reference to FIGS. 1-4. In general, the method can include mounting the assembly 10 to a limb 91 of the archery bow 90, moving a mounting block 40 between the first end and a second end of the rail along a longitudinal axis LA to a position along the rail 30, optionally aligned with an indicia element 37 of a scale; and joining an arrow rest activation cord 98 with an anchor 50 joined with the mounting block 40, optionally in a preselected location.

The method optionally can include selectively aligning the mounting block 40 with at least one indicia element 37 of the scale along the rail 20 to set the anchor 50 and activation cord 98 in a preselected position. In turn, this can tune the activation cord for proper activation and movement of the lever 97 and support arm 95 of an arrow rest 94 to which the activation cord 98 is attached. In some cases, the base and rail, and the assembly in general can be mounted to the limb so that the end of the same projects a first distance D beyond a tip 91T of the limb in a cantilevered manner. More particularly, the base 20 and rail 30, optionally with the mounting block 40 and anchor 50 attached thereto, can be fastened to the limb 91 near the tip 91T and/or the axle screw or axle 91A. This fastening can be achieved by placing the limb fasteners 23 and 24 through the respective limb fastener holes 23H and 24H. When these limb fasteners 23 and 24 are tightened, the base, in particular the upper surface of the base, can engage the lower surface 91L of the limb 91 and any associated contours of it. In some cases, a rubber bumper or soft pad (not shown) can be placed between the assembly base and the limb surface.

Optionally, where the base, rail and assembly in general are configured to extend beyond the tip 91T the distance D, the second ends 22 and 32 of the respective base and rail can be placed beyond that tip 91T in a cantilevered manner.

With the assembly 10 secured to the limb 91, a user can tie the activation cord 98 to the anchor 50 by placing the activation cord through the aperture or other attachment portion of the anchor 50. The user can tie the opposite end of the activation cord 98 to the lever 97 of the arrow rest 94. The user can then adjust the length of the cord and ensure that it has appropriate tension in it.

To adjust the support period of the arrow 99 by the support arm 95, to a particular amount of time or to the user's preference, the user can move the mounting block 40 and thus the anchor and activation cord 98 relative to the rail 20, base 30 and the assembly 10 in general. For example, the mounting block, anchor and cord can be moved in rearward direction R or forward direction F. To do so, the user can use a tool T as shown in FIG. 2 and loosen the lock fasteners 49 and 48 so that those fasteners disengage the surfaces of the respective first and second recesses 25 and 26 of the rail. Before doing so, the user can take note of the particular indicia element, for example, indicia element 37A shown in FIG. 3, relative to the first edge 41 of the mounting block 40. After appropriate loosening of one or both of the locking fasteners 49 and 48, the user can move the mounting block 40 along the rail, in which case it traverses one or more of the indicia elements, which again can be in the form of simple lines, in some cases associated with alphanumeric characters for reference. The user can move the mounting block 40 until the first edge 41 aligns with a second indicia element 37B, shown in FIG. 3. In so doing, the activation cord 98 changes its movement characteristics because it is now attached to the limb 91 at another portion of the limb which moves differently from the previous location where the edge 41 was aligned with indicia element 37A. Accordingly, the amount of support time, having moved in a rearward direction, can be increased.

Moving the mounting block 40, anchor 50 and cord 98 in the forward direction F can conversely decrease the amount of time during a shot cycle when the arm 95 supports the arrow 99. In some cases, a user can incrementally adjust and move the mounting block 40, anchor 50 and associated activation cord 98 relative to the rail and indicia elements, taking notes and selecting a suitable location of the components relative to the rail, base and limb 91. As noted above, when a suitable location is selected, the user can tighten the locking fasteners 48 and 49 with a tool T to secure the mounting block in a particular location, with the edges of the mounting block 40 or some other component aligned with a particular indicia element. If the user adjusts the draw weight of the associated archery bow 90, changes their bowstring, or tunes the bow differently, the user can again test the support time of the arrow rest and make further adjustments if appropriate via the limb attachment assembly 10.

Figure 5:
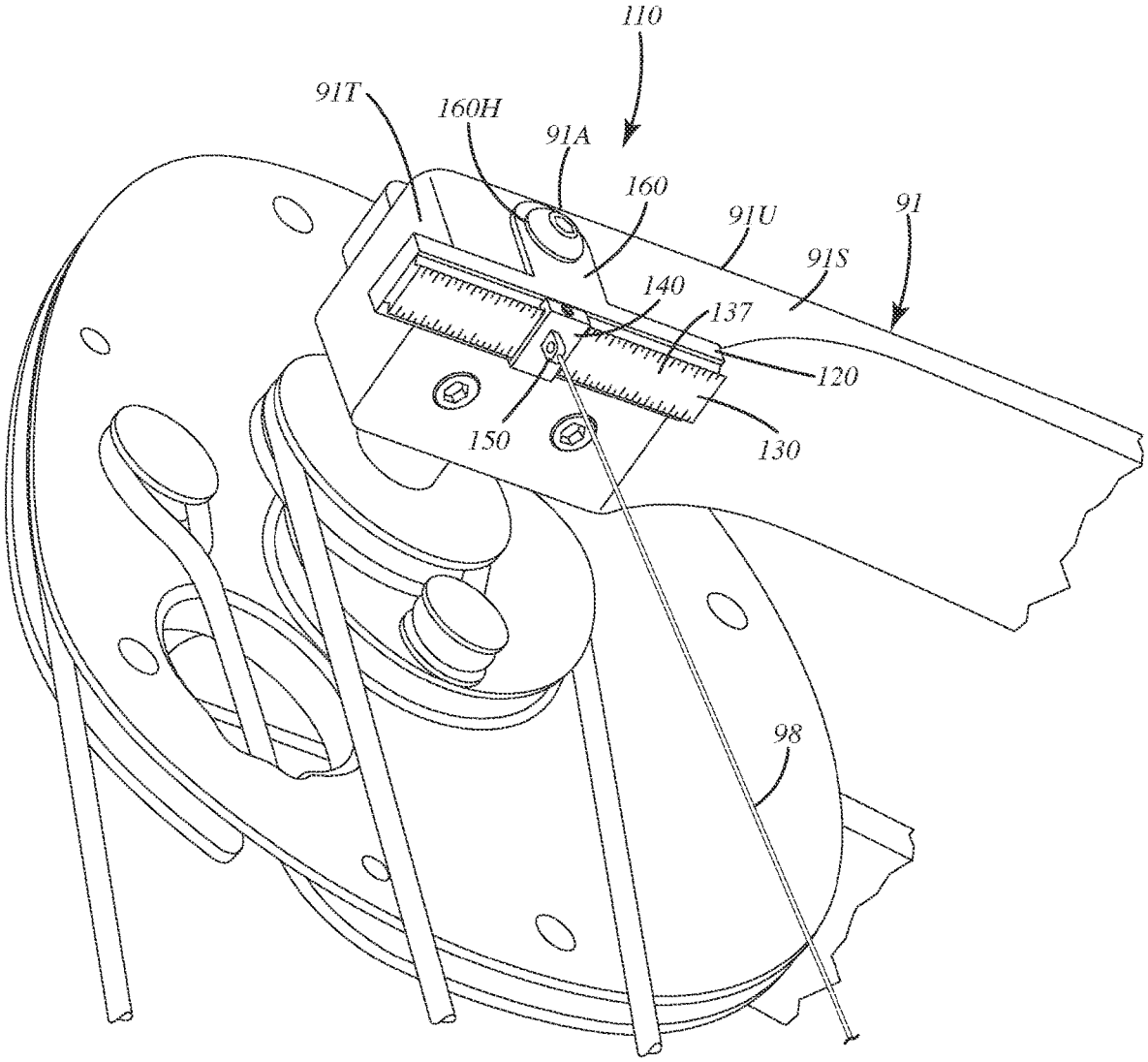
FIG. 5 is a perspective view of a first alternative embodiment of the limb attachment assembly.

A first alternative embodiment of the limb attachment assembly is shown in FIG. 5 and generally designated 110. This embodiment is similar to the above embodiment in structure, function and operation with several exceptions.

For example, the assembly 110 can include a base 120 that is positioned adjacent a limb surface of the limb 91, a rail 130 including indicia elements 137, and a mounting block 140 joined with an anchor 150. The mounting block 140 and anchor 150 can be selectively movable along the rail as described in the embodiment above. In this embodiment however, the assembly 110 can be attached to limb 91 via a connector 160 which is shown in the form of a tab that extends from the base 120. The tab 160 can be integrally formed or fastened to the base 120. The tab 160 can extend upwardly and can define an aperture 160H. The axle and/or axle screw 91A can be placed through the aperture 160H to secure the limb attachment assembly 110 to the limb 91 in a fixed position. The mounting block, anchor and activation cord 98 can be moved and adjusted to tune the support time of a support arm 95 of an arrow rest to which the activation cord 98 is joined.

Optionally in this embodiment, the end of the rail and base can extend beyond the distal tip of the limb 91 as with the embodiment above. Of course, in other constructions it might not extend beyond the tip 91T in a cantilevered manner. Further optionally, the base 120 can sandwich between it and the surfaces of the limb 91 a pad (not shown), which can be constructed from a soft, contoured and/or compliant material to provide a cushion between the base and the limb. In some cases, the pad can come in different thicknesses to accommodate different limbs having different placements of the axle or axle fastener 91A.

Figure 6:
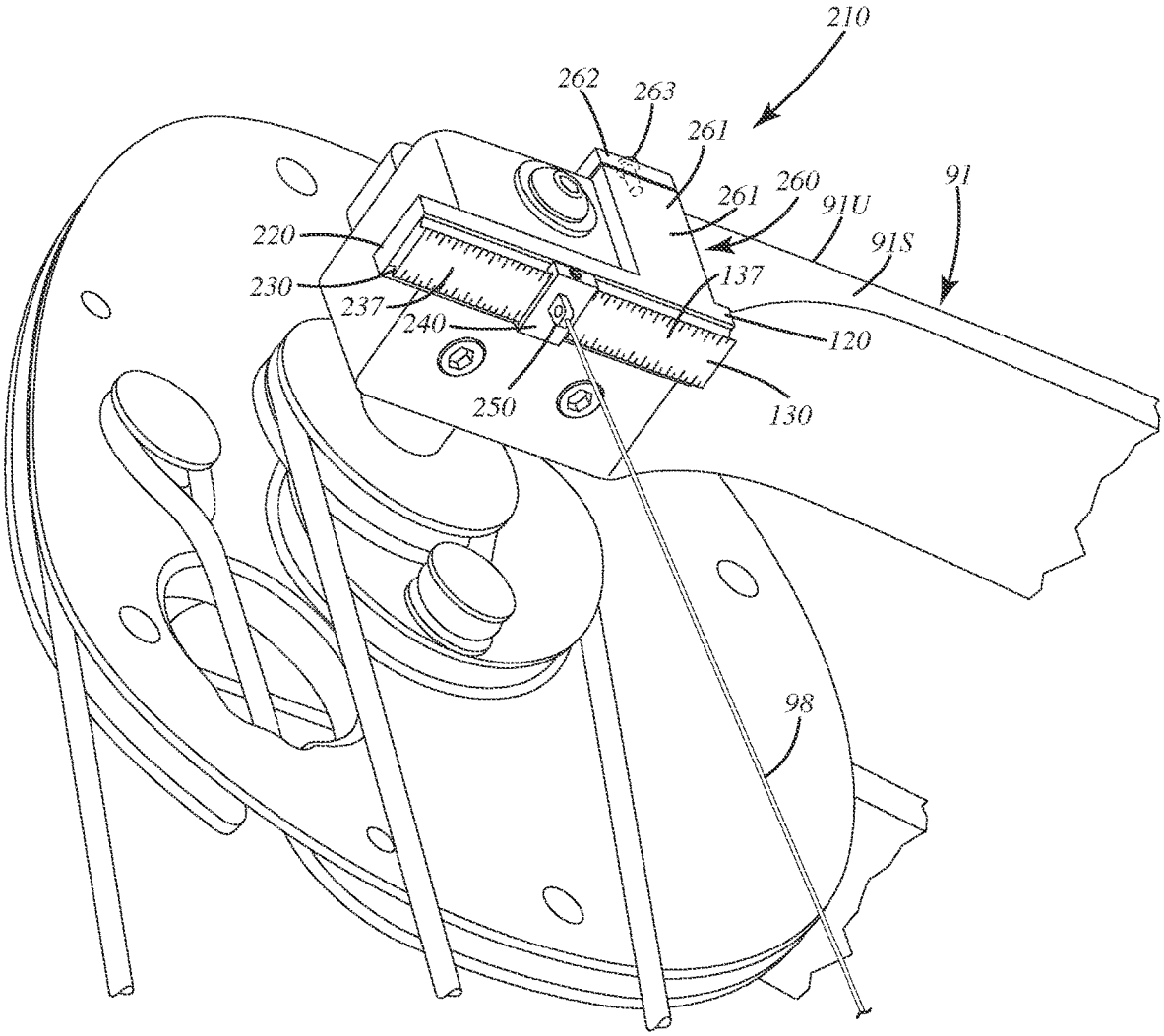
FIG. 6 is a perspective view of a second alternative embodiment of the limb attachment assembly.
Figure 7:
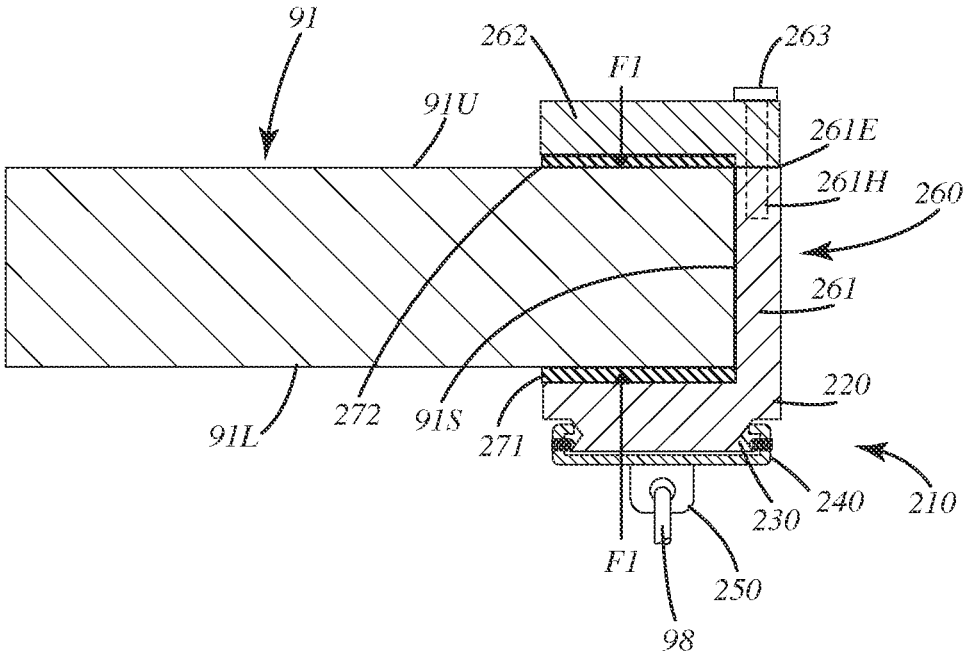
FIG. 7 is section view of the second alternative embodiment of the limb attachment assembly.

A second alternative embodiment of the limb attachment assembly is shown in FIGS. 6 and 7 and generally designated 210. This embodiment is similar to the above embodiments in structure, function and operation with several exceptions. For example, the assembly 210 can include a base 220 that is positioned adjacent a limb surface of the limb 91, a rail 230 including indicia elements 237, and a mounting block 240 joined with an anchor 250, the mounting block 240 and anchor 250 being selectively movable along the rail as described in the above embodiments. In this embodiment however, the assembly 210 can be attached to limb 91 via a connector 260 which is in the form of a clamp. This connector 260 can include a plate 261 that extends upwardly from the base 220, along a side surface 91T of the limb 91. The base can be placed adjacent the lower surface 91L of the limb 91. An optional pad 271 can be placed between the base 220 and that surface 91L. Further optionally, another pad 272 can be placed between the clamp plate 262 and the upper surface 91U of the limb 91 to provide grip of the clamp on the limb, to follow the contours of the limb surfaces that the clamp and base engage, and/or to prevent marring of the limb surfaces.

The plate 261 can extend upwardly along the side surface 91S of the limb 91. The plate 261 can include an aperture 261H, which optionally can be threaded to receive a fastener 263 which also optionally can be threaded. The head of the fastener 263 can engage the clamp plate 262 so that it is drawn toward the end 261E of the plate 261. Accordingly, when the clamp plate 262 is placed adjacent the upper surface 91U of the limb 91, and the base 220 is placed adjacent the lower surface 91L of the limb, and the fastener 263 is tightened, the clamp 260 in conjunction with the base 220 can exert forces F1 on the upper and lower surfaces of the limb 91, optionally through the pads 271 and 272 if included. In turn, this force F1 securely attaches the assembly 210 to the limb 91. After it being attached, the assembly 210 can be adjusted to tune the timing of the activation cord 98 and the support arm of the arrow rest. Although not shown, the clamp can take on a variety of different configurations and can engage other surfaces of the limb. For example, the clamp 260 can alternatively clamp the side surfaces of the limb 91, or a combination of side surfaces, with or without the upper and lower surfaces, depending on the application.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An arrow rest activation cord limb attachment assembly comprising:

an elongated base defining at least one hole configured to receive a limb fastener therethrough to secure the elongated base to a limb of an archery bow adjacent a tip of the limb and an axle supporting a cam of the archery bow;

a rail joined with and extending along the elongated base and including a longitudinal axis, the rail mountable to the base with the longitudinal axis transverse to an axis of rotation of the cam, the rail including a first end and a second end distal from the first end, the rail having a scale of indicia elements positioned between the first end and the second end;

a mounting block slidably joined with the rail and moveable there along between the first end and the second end in a linear manner along the longitudinal axis to a plurality of discrete locations, the mounting block including at least one edge that aligns with at least one of the indicia elements of the scale to provide visual feedback to a user with regard to the location of the mounting block along the rail; and an anchor joined with the mounting block and configured to receive an activation cord, the anchor being moveable with the mounting block along the rail, whereby the mounting block can be selectively positioned along the rail and aligned with at least one of the indicia elements of the scale to set the anchor and activation cord relative to the limb and thereby tune the activation of an arrow rest mounted to the archery bow with the activation cord.

2. The assembly of claim 1, wherein rail includes a first recess on a first side of the longitudinal axis and a second recess on an opposing second side of the longitudinal axis.

3. The assembly of claim 2, wherein the mounting block includes a first arm and a second arm distal from the first arm, wherein the first arm is slidably mounted relative to the first recess, wherein the second arm is slidably mounted relative to the second recess.

4. The assembly of claim 3 comprising:

a fastener threadably engaged with the mounting block including a fastener tip, wherein the fastener tip engages the rail to secure the mounting block in a preselected position along the rail.

5. The assembly of claim 1, wherein the mounting block is channel shaped and extends over and conceals a portion of the indicia elements, while a remaining portion of the indicia elements are exposed and located between the at least one edge and the first end.

6. The assembly of claim 1, wherein the mounting block includes a central portion and opposing, downward extending arms that are configured to engage the rail on opposite sides of the longitudinal axis.

7. The assembly of claim 1, wherein the at least one hole extends completely though the rail, wherein the at least one hole is sized to receive a head of the limb fastener so that the head of the limb fastener is disposed below a display surface upon which the indicia elements are located.

8. The assembly of claim 7, wherein the mounting block is selectively slidable relative to the rail over the display surface and the head of the limb fastener without the limb fastener impairing movement of the mounting block.

9. The assembly of claim 1, wherein the rail and base are mountable to the limb so that the first end of the rail projects a first distance beyond the tip of the limb.

10. The assembly of claim 1, wherein the first end extends in a cantilevered manner beyond the tip of the limb.

11. An arrow rest activation cord limb attachment assembly comprising:

an elongated base mountable to a limb of an archery bow;

a rail joined with the elongated base and including a longitudinal axis extending between a first end and a second end;

a mounting block moveable between the first end and the second end along the longitudinal axis to a plurality of discrete locations; and an anchor joined with the mounting block and configured to receive an activation cord, the anchor being moveable with the mounting block along the rail, whereby the mounting block can be selectively positioned along the rail to set the anchor and activation cord relative to the limb and thereby tune the activation of an arrow rest mounted to the archery bow with the activation cord.

12. The assembly of claim 11 comprising:

a plurality of indicia elements of a scale disposed between the first end and the second end of the rail.

13. The assembly of claim 12, wherein the mounting block includes at least one edge that aligns with at least one of the indicia elements of the scale to provide visual feedback to a user with regard to the location of the mounting block along the rail.

14. The assembly of claim 11, wherein the base is mountable to the limb so that the first end projects a first distance beyond a tip of the limb.

15. The assembly of claim 11, wherein the first end extends in a cantilevered manner beyond a tip of the limb.

16. The assembly of claim 11, wherein the mounting block includes a first arm and a second arm distal from the first arm, wherein the first arm is slidably mounted to the rail, wherein the second arm is slidably mounted to the rail distal from the first arm such that the rail is located between the first arm and second arm.

17. The assembly of claim 11 comprising:

a fastener threadably engaged with the mounting block including a fastener tip, wherein the fastener tip engages the rail to secure the mounting block in a preselected position along the rail.

18. A method of attaching an arrow rest activation cord to an archery bow, the method comprising:

mounting a rail to a limb of an archery bow, the rail including a longitudinal axis extending between a first end and a second end;

sliding a mounting block between the first end and the second end along the longitudinal axis to a position along the rail aligned with an indicia element of a scale; and joining an arrow rest activation cord with an anchor joined with the mounting block.

19. The method of claim 18 comprising:

selectively aligning the mounting block with at least one indicia element of the scale along the rail to set the anchor and activation cord at a preselected position, whereby activation of an arrow rest mounted to the archery bow with the activation cord is tuned.

20. The method of claim 18 comprising:

mounting the rail to the limb so that the first end projects a first distance beyond a tip of the limb in a cantilevered manner.

* * * * *